United States Patent [19]

Boyle

[11] 4,188,991

[45] Feb. 19, 1980

[54] WIND-AND-SUN SHIELD

[76] Inventor: Carol J. Boyle, 464 N. Harbor City Blvd., P.O. Box 1434, Melbourne, Fla. 32935

[21] Appl. No.: 851,723

[22] Filed: Nov. 15, 1977

[51] Int. Cl.[2] ..... A47H 1/00

[52] U.S. Cl. ..... 160/124; 160/330; 160/348

[58] Field of Search ..... 160/124, 126, 330, 348, 160/354, 241, 84 R, 123, 125, 349 R, 349 D

[56] References Cited

U.S. PATENT DOCUMENTS

| | | | |
|---|---|---|---|
| 418,693 | 1/1890 | Day | 160/348 |
| 1,070,717 | 8/1913 | Nielsen | 160/125 |
| 1,711,304 | 4/1929 | Beste | 160/124 |
| 2,298,783 | 10/1942 | Burnett | 160/354 |
| 2,522,358 | 9/1950 | Franson et al. | 160/348 |
| 2,609,043 | 9/1952 | Dubinsky | 160/124 |
| 2,752,993 | 7/1956 | Scott | 160/330 |
| 2,771,945 | 11/1956 | Wittrup | 160/124 |
| 2,859,810 | 11/1958 | Sachs | 160/124 |
| 3,001,578 | 9/1961 | Ratliff | 160/126 |
| 3,132,686 | 5/1964 | Judouits | 160/348 |
| 3,236,290 | 2/1966 | Lueder | 160/241 |
| 4,020,826 | 5/1977 | Mole | 160/330 |

*Primary Examiner*—Peter M. Caun
*Attorney, Agent, or Firm*—Harold Gell

[57] ABSTRACT

A removable drapery liner incorporating box pleats and grommets to permit hanging the liner by the same devices which are used to suspend the cooperating draperies is presented. The box pleats are dimensioned so that the liner will follow the contour of the draperies it is backing and permit the reversible installation of the lining so that a silvered side may be used to reradiate heat into a room or alternately reflect radiant energy from the sun out of the room. Fasteners are provided to secure liner panels together and to window casements.

13 Claims, 7 Drawing Figures

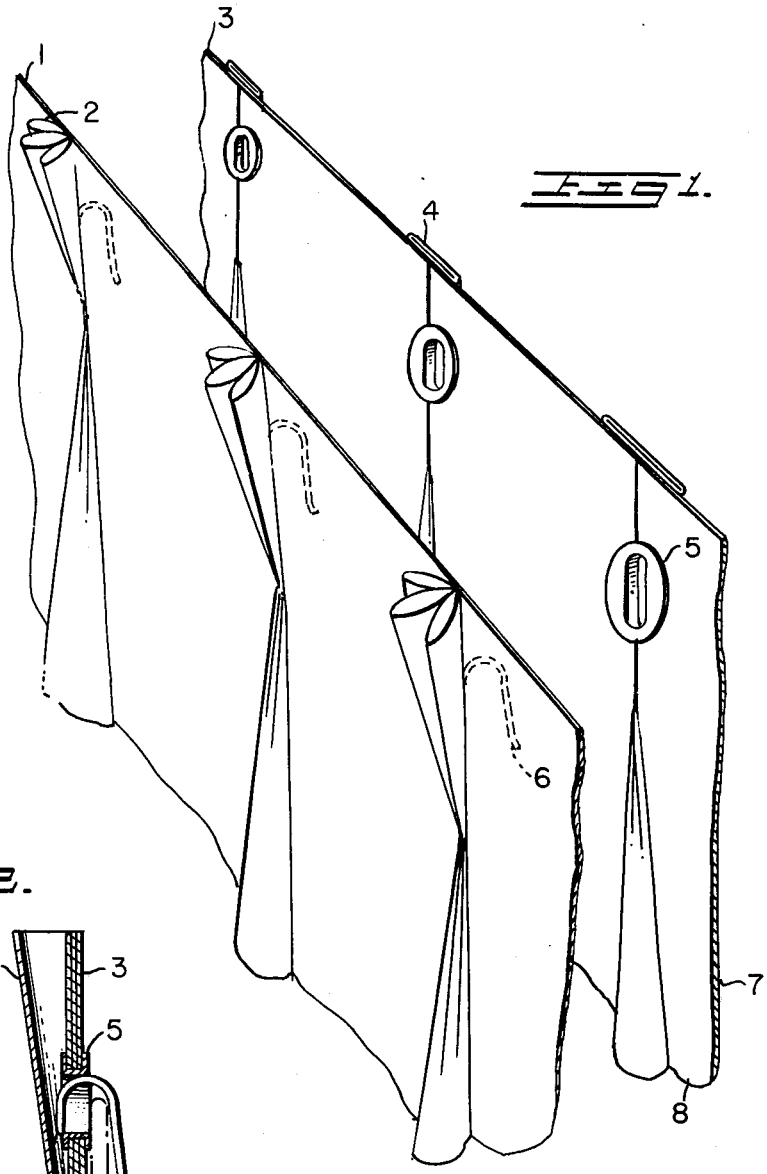
Fig 1.
Fig 2.
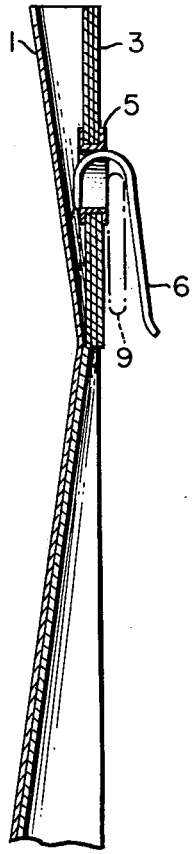
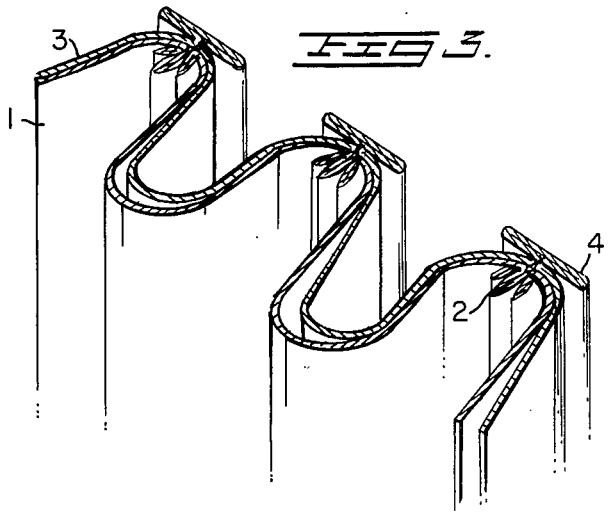
Fig 3.

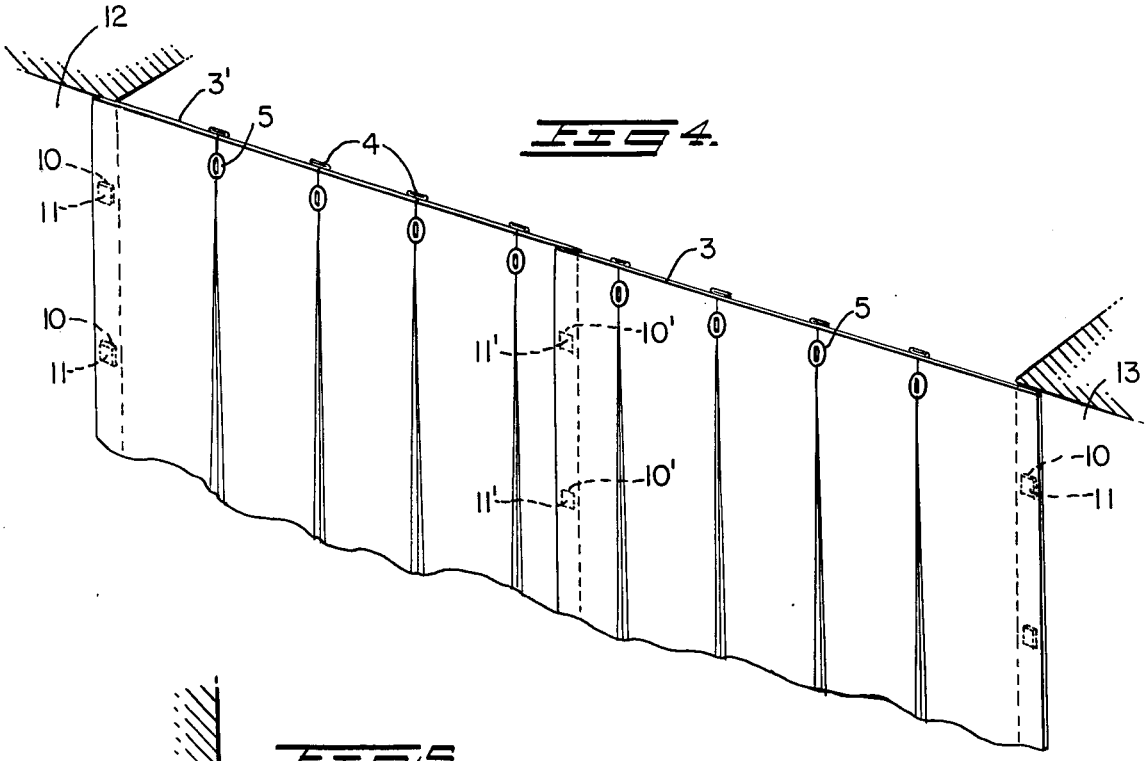
FIG 4.
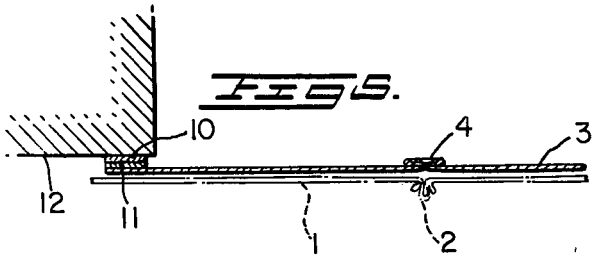
FIG 5.
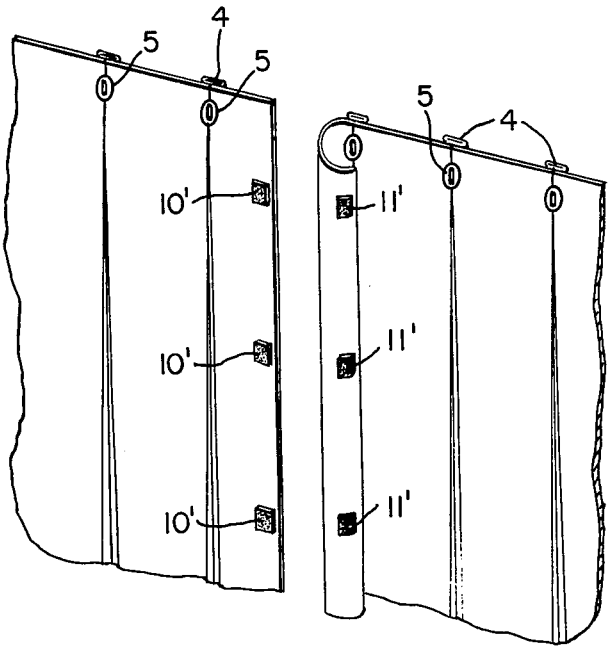
FIG 6.
FIG 7.
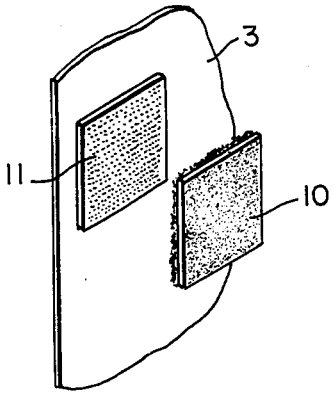

WIND-AND-SUN SHIELD

THE INVENTION

This invention relates to an energy conservation device in the form of draperies and drapery linings adapted to inhibit drafts and prevent solar radiation from excessively heating a room in the summertime or to absorb radiation and reflect heat into a room in the winter.

BACKGROUND OF THE INVENTION

Since the advent of windows in dwellings, man has been attempting to modify heat loss or absorption through these openings and thus conserve energy.

One general category of devices attempting to solve this problem has been the use of draperies. However, draperies have been used predominantly for ornamental purposes and privacy and their energy conservation effects are minimal. Double hung draperies have also been utilized in the past but these devices are relatively clumsy and unattractive and are provided for reasons other than energy conservation. For instance the double hung drapery of Syrett in U.S. Pat. No. 1,424,324 is provided as a dust shield and as such does not incorporate reflective or absorptive surfaces required for energy conservation. E. Roy in U.S. Pat. No. 1,567,196 illustrates a double hung drapery or curtain but fails to suggest that the device encompasses the concept of a drapery liner having thermal or radiation barrier properties. The double hung draperies presented in the prior art have additional drawbacks in that they require special considerations for hanging such as additional rods or hooks and they are not manufactured in a way which will permit their folding in a pattern identical to the associated draperies and thus they detract from the esthetic appeal of the draperies.

Other energy conservation measures have been utilized with respect to windows which includes applying a reflective film directly to the glazing. This approach is satisfactory in eliminating solar radiation from a room and thus minimizes solar heating so that air conditioning of the room may be accomplished in an economical manner. However, that concept also prevents solar heating of the room during the cooler months of the year and thus increases the energy costs for heating the room. The reflective coatings on the glazing also inhibits observation through the windows from the reflective side.

OBJECTIVES OF THE INVENTION

In view of the urgent requirement for energy conservation placed upon our society and the excessive energy waste associated with radiation and drafts through windows, it is an object of the present invention to provide a means whereby solar radiation may be excluded from an area or alternately absorbed through a window and room radiation reflected back into the room.

Another objective of the present invention is to provide a drapery liner incorporating a radiation reflective surface which is adapted to be hung by the same hangers supporting the draperies with which the liner cooperates.

Another objective of the present invention is to provide drapery liners incorporating pleating techniques which will permit the liners to closely follow the folds of the drapery material so that the liners will be unobtrusive.

Another objective of the present invention is to provide drapery liners which will inhibit drafts normally found in poorly fitting window casings or created by the temperature differential of the air immediately adjacent to the window pane and the ambient air within a room.

A still further objective of the present invention is to provide drapery liners capable of preventing radiant energy from heating a room through a window during the warm months of the year while permitting the heat radiation to enter the room during the cool months of the year.

Another objective of the invention is to provide fasteners along the edge of liner panels so that they may be secured together to form panel assemblies of increased width.

Another objective is to provide fasteners to the edges of the liners so that they may be secured to window or door casements through the use of mating fasteners.

SUMMARY OF THE INVENTION

The invention disclosed herein is a drapery fabricated from a material having one surface which will reflect radiant energy and an opposite surface which will absorb radiant energy. In a preferred embodiment, the drapery is adapted to be a drapery liner fabricated with a flat, box pleat dimensioned so that the drapery liner material will fold in a pattern identical to a pinch pleat drapery. Included in the box pleat area of the drapery liner are grommets adapted to permit the drapery liner to be suspended by the same hooks which suspend the draperies with which the liners cooperates. The combination of box pleat and grommet positions permits the drapery liner, when hung behind a drapery, to fold in exactly the same pattern as the cooperating drapery.

The box pleat and grommet structure of the drapery liners is further adapted to permit hanging the draperies in a first position so that solar radiation will be reflected from a room or in a second position so that solar radiation will be absorbed and room radiation reflected back into the room.

The drapery liners are provided with fasteners along their edges which are positioned to that the fasteners on adjacently hung liner panels will mate to secure the panels together. The position of the fasteners is also calculated to enable securing the outer edges of the drapery liner to window or door casements by mating connectors which are adhesively secured to the casements.

DESCRIPTION OF THE DRAWINGS

FIG. 1 is a perspective view of a section of a drapery lining set slightly apart from a drapery.

FIG. 2 is a side, cutaway view of a drapery and drapery liner.

FIG. 3 is a top, cutaway perspective view of the drapery and drapery liner illustrating the cooperation of pinch pleats in the drapery and the box pleats in the liner.

FIG. 4 illustrates a pair of drapery liners secured together and to casements by fasteners incorporated in the edges of the panels.

FIG. 5 is a top view illustrating the mating of a fastener on a drapery liner panel and casement.

FIG. 6 illustrates the positioning of connectors on adjacent drapery liner panels.

FIG. 7 illustrates a preferred fastener in a demated position.

DESCRIPTION OF THE INVENTION

FIG. 1 illustrates a common window drapery 1 of the type which is normally hung on traverse rods by hook means such as the phantom hooks 6 illustrated behind the pinch pleat portions 2 normally incorporated in such draperies to enhance their appearance and facilitate the opening and closing of the draperies. Positioned apart and slightly behind the drapery 1 of FIG. 1 is a section of the novel drapery liner presented herein. The liner 3, incorporates flat, box pleats 4 spaced identical to the pinch pleat 2 of the draperies 1. Grommets 5 are provided in each box pleat to permit the drapery hooks to pass therethrough and support the drapery lining in addition to supporting the primary drapery.

One side of the drapery liner 3 has a radiation reflective finish 8 which functions to reflect solar radiation out of a window or heat radiation back into a room. The opposite side of the drapery has a radiation absorptive finish 7 which functions to absorb solar radiation when facing a window so that the drapery liner will ensure that the maximum solar heating of a dwelling is realized during the winter months. The material from which the drapery liner 3 is fabricated is a solid film, a densely woven fabric adapted to inhibit the passage of drafts therethrough, or a woven fabric with a reflective film secured to one side.

FIG. 2 is a side, cutaway view of the combined drapery 1 and drapery liner 3 taken along a line passing vertically through the center of the pinch and box pleats, bisecting the grommet 5. In FIG. 2 the drapery hook 6 can be seen passing through the grommet 5 and into the fabric 1 of the primary drapery so that both drapery and liner are supported on the traverse rod attachment fitting 9. Note also in this illustration that the drapery liner 3 closely follows the fabric of the drapery below the pleated section as a function of the box pleat dimensions.

The cutaway view of FIG. 3 is taken horizontally through the drapery material 1 and drapery liner 3 at the pinch part of the drapery pinch pleat 2. This illustration depicts how the flat, box pleat permits the drapery liner to accordian fold as the drapery material accordian folds so that the drapery liner will be unobtrusive. The box pleat is approximately 4 inches long so that it terminates at the lowest portion of the stitching in the pinch pleat of the primary drapery as can be seen in FIG. 2. This causes the lower, flared portion of the drapery liner to fold identically with the flared portion of the drapery 1.

In a preferred embodiment of the present invention, the drapery liner is fabricated from a vinyl-backed cotton material 7 having a silvered or metallic polyester film 8 secured to one side which functions as the reflective surface. A neutral color, mat finish may be used on the opposite side which functions as the heat absorptive side of the drapery 7. It is contemplated that the drapery liner fabricated as described above may be used as a primary drapery and provided with pinch pleats instead of flat pleats.

The draperies are utilized to conserve energy in the summertime by hanging the drapery liners against the back of the window draperies so that the reflective side 8 faces the window. Thus when the drapes are closed, the suns energy entering the window will be reflected back out of the window by the surface 8 of the drapery liner 3.

In the winter the drapery liner functions as an energy conservation means when hung such that the reflective side 8 faces the back of the drapery. Thus when the draperies are drawn the heat and radiation absorptive side of the liner 7 faces the window and the suns radiation tends to warm the drapery materials and prevent excessive radiation back out of the window. Also, radiation from within the room is reflected back into the room by the reflective surface 8 of the drapery liner facing the back of the drapery.

FIG. 4 illustrates two drapery liner panels joined together by fasteners, which in a preferred embodiment are the type comprised of a pile mating surface and a hook mating surface commonly referred to by the tradename Velcro. In a preferred embodiment, the hook halves 11 of the connectors are affixed to one vertical edge on the reflective side of the drapery liner and the pile halves 10 of the connectors are affixed to the non-reflective side of the panels along the vertical edge opposite the vertical edge to which the hook halves of the connectors were fastened. For instance in FIG. 6 note the pile halves 10′ are affixed to one side of the drapery panel and the hook halves 11′ are affixed to the opposite side of the adjacent panel so that the two panels may be positioned as illustrated in FIG. 4 with connector halves 10′ mating with adjacent connector halves 11′.

The drapery panels are also supplied with loose fastener pairs having pressure sensitive adhesive backings so that they may be secured to casements as illustrated in FIGS. 4 and 5. In FIG. 5 note that the pile half 10 is secured to a casement 12 by the pressure sensitive adhesive backing and the hook half of a connector pair which is normally sewn to the drapery liner mates with the pile half 10 to securely hold the drapery liner along the edge of the casement 12. In FIG. 5 the primary drapery is shown in phantom.

The connectors 10 and 11 at the right side of FIG. 4 securing the edge of the drapery panel to casement 13 are provided by connector pairs having pressure sensitive backings. Along this edge of the drapery panel the pressure sensitive backing of the hook or pile half is secured to the reflective side of the drapery panel opposite the pile half connector 10 which is sewn to the drapery. The mating half of the pressure sensitive coupling pair is then secured to casement 13 so that the edge of the liner may be fastened along the casement to prevent drafts from circulating past the drapery edges.

FIG. 7 illustrates the hook half 11 of a coupling pair which may be sewn to the drapery liner 3 or adhered thereto by a pressure sensitive backing. The pile half of the coupling pair 10 is illustrated in a suspended position.

Although preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim as a new and useful contribution to the art and for which I desire letters patent is:

1. An energy conservation apparatus cooperating with draperies, comprising:

a drapery including a plurality of pinch pleats spaced along the top edge of said drapery;

a drapery liner incorporating a plurality of equally spaced flat, box-pleats along a top edge of said drapery liner, said box-pleats extending down said drapery liner for a distance approximately equal to the distance of said pinch pleats in said drapery;

means to hang said drapery; and a grommet set in each of said flat, box-pleats in alignment with said means to hang said drapery when said drapery and said drapery liner are superimposed.

2. An apparatus as defined in claim 1 wherein said drapery liner has a solar and heat radiation reflective finish on one side and a radiation absorptive finish on the opposite side.

3. An apparatus as defined in claim 2 wherein said drapery liner is fabricated from a plastic film material.

4. An apparatus as defined in claim 2 wherein said drapery liner is fabricated from a densely woven fabric and said reflective surface is a thin film of flexible, reflective material.

5. An apparatus as defined in claim 2 wherein said radiation reflective finish is a polyester film and said absorptive finish is a vinyl-back fabric.

6. An apparatus as defined in claim 5 wherein said woven fabric is cotton.

7. An apparatus as defined in claim 1, comprising:

a plurality of drapery liner panels, each of which includes;

a first fastener affixed on one side of said drapery liner adjacent to one vertical edge and a second fastener adapted to mate with said first fastener affixed to the opposite side adjacent to the opposite vertical edge of said drapery liner.

8. An apparatus as defined in claim 7 wherein said first fastener is comprised of a plurality of hook members secured to a common base; and said second fastener is comprised of a fabric pile.

9. An apparatus as defined in claim 8, comprising: third and fourth fasteners having mating surfaces identical to said first and second fasteners respectively, said third and fourth fasteners including pressure sensitive adhesive surfaces opposite said fastening surfaces, said third and fourth fasteners to be secured to a surface other than said drapery liner for securing said drapery liner thereto.

10. An energy conservation apparatus, comprising:

a drapery including a plurality of pinch pleats spaced along the top edge of said drapery;

a fabric panel including a solar radiation reflective film secured to one side of said fabric and incorporating a plurality of equally spaced, flat, box-pleats formed along one edge of said fabric panel to permit said fabric panel to hang in folds in a manner identical to said drapery when suspended by a means passing through the fabric forming said box-pleats and engaging said pinch pleats to support said drapery;

a first fastener affixed to one side of said drapery; liner adjacent to one vertical edge; and a second fastener adapted to mate with said first fastener affixed to the opposite side adjacent to the opposite vertical edge of said drapery liner.

11. An apparatus as defined in claim 10, wherein said fabric panel is fabricated from a woven material and said reflective film is a polyester.

12. An apparatus as defined in claim 10 wherein said first fastener is comprised of a plurality of hook members secured to a common base; and said second fastener is comprised of a fabric pile.

13. An apparatus as defined in claim 12, comprising: third and fourth fasteners having mating surfaces identical to said first and second fasteners respectively, said third and fourth fasteners including pressure sensitive adhesive surfaces opposite said fastening surfaces, said third and fourth fasteners to be secured to a surface other than said drapery liner for securing said drapery liner thereto.

* * * * *